United States Patent [19]

Frei

[11] 4,224,982

[45] Sep. 30, 1980

[54] TUBULAR HEAT EXCHANGER

[76] Inventor: Willi Frei, Höchsterstrasse 11b, CH-9016 St. Gallen, Switzerland

[21] Appl. No.: 958,671

[22] Filed: Nov. 8, 1978

[30] Foreign Application Priority Data

Dec. 6, 1977 [DE] Fed. Rep. of Germany ..... 2754197

[51] Int. Cl.[3] ..... F28F 9/16

[52] U.S. Cl. ..... 165/134 R; 165/69; 165/82; 165/140; 165/141; 165/159; 165/173; 165/DIG. 8

[58] Field of Search ..... 165/134, 135, 159, 160, 165/161, 172, 173, 175, 70, 69, 82, 134 R, 140, 141, DIG. 8

[56] References Cited

U.S. PATENT DOCUMENTS

| | | | |
|---|---|---|---|
| 2,834,581 | 5/1958 | Schefels et al. | 165/135 |
| 2,915,295 | 12/1959 | Boni, Jr. | 165/134 |
| 2,966,339 | 12/1960 | Morgan | 165/134 |
| 3,001,766 | 9/1961 | Laist | 165/134 |
| 3,152,548 | 10/1964 | Schwartz | 165/134 |
| 3,326,279 | 6/1967 | Eisberg et al. | 165/134 |
| 3,447,603 | 6/1969 | Jones | 165/69 |
| 3,465,727 | 9/1969 | Tidball | 165/134 |
| 3,633,660 | 1/1972 | Young | 165/69 |

FOREIGN PATENT DOCUMENTS

| | | | |
|---|---|---|---|
| 1324945 | 12/1963 | France | 165/134 |
| 724258 | 2/1955 | United Kingdom | 165/175 |
| 233702 | 4/1969 | U.S.S.R. | 165/134 |

*Primary Examiner*—Sheldon Richter

[57] ABSTRACT

A tubular heat exchanger comprises tubes mounted between upper and lower plates employing a heat- and acid-sensitive resin at the upper plate. To prevent a fluid medium from corroding the resin, a further plate comprising an acid- and heat-resistant material is provided separating the medium from the resin, and a cooling medium is flowed through the separating space.

4 Claims, 3 Drawing Figures

TUBULAR HEAT EXCHANGER

The invention relates to a tubular heat exchanger having a stack of tubes which are held at their ends respectively in a perforated sheet metal plate on which is located a layer of sealing casting resin and having a housing with an inlet and an outlet for a medium passing in the direction of flow through the tubes and with an inlet and an outlet at right angles to the flow through the tubes.

With such tubular heat exchangers which have proved to be satisfactory in practice the tubes consist preferably of silicate glass and the casting resin which seals the stack of tubes at the ends is made of silicon resin.

For many purposes it has been found that the casting resin at very high temperatures is no longer stable. This temperature limit is about 250° Celsius. In addition the casting resin is attacked by many chemicals, in particular, acids. Due to the excess pressure prevailing inside a tubular heat exchanger between the stack of tubes the fluid flowing therethrough, which, for example, may be air saturated with an acid is also driven through the perforated sheet metal plates for the casting resin and thus damages the casting resin. Added to this is the fact that in the tubular heat exchanger this air is saturated with acid or acid anhydride is cooled so that the anhydride deposits on the tubes and thus also in the sealing mass in a liquid form. The invention is therefore based on the problem of improving the tubular heat exchanger hereinbefore described so that the sealing layer made of casting resin is protected from excessively high temperatures and chemicals not compatible with the casting resin.

With a tubular heat exchanger of the above mentioned type this is achieved according to the invention in that at a distance from the layer of casting resin a layer of acid resistant and heat resistant material is provided.

This second layer forms together with the space formed between the two layers an insulation which insulates mainly thermally the layer of casting resin. In the area of the casting resin, therefore, no deposit can form on the outer walls of the tubes. Additionally, the acid resistant and heat resistant layer acts so that the fluid flowing through the exchanger at right angles to the tubes is kept away from the layer of casting resin.

The effect is improved when the space formed between the layers has an inlet for a medium flowing through the space. This medium is preferably air or another gas under high pressure. The increased gas cushion thereby formed in this space prevents a penetration of the fluid flowing at right angles to the tubes from entering into the space between the layers and thus in the region of the layer of casting resin.

Particularly satisfactory results can be achieved when the layer consists of mineral wool which is held between sheet metal plates.

The invention will be described with reference to the accompanying drawings.

The tubular heat exchanger shown consists of a stack of glass tubes (1) arranged parallel to one another. The tubes (1) are held at one end respectively by perforated sheet metal plates (2.)

Figure 1:
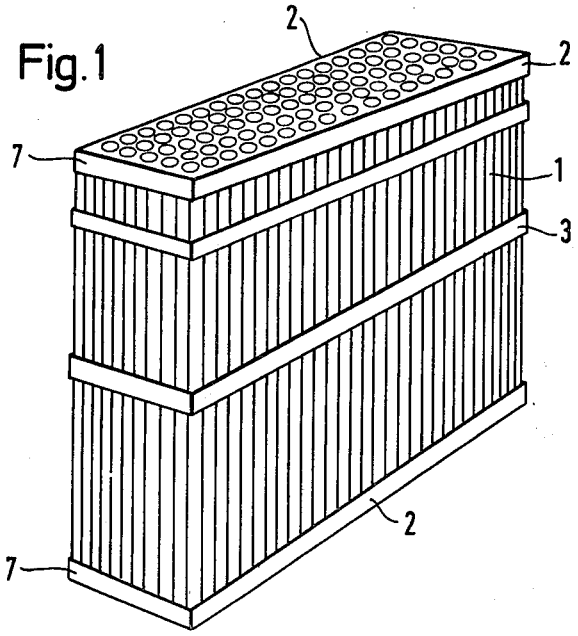
FIG. 1 shows a prespective view of a tubular heat exchanger.
Figure 2:
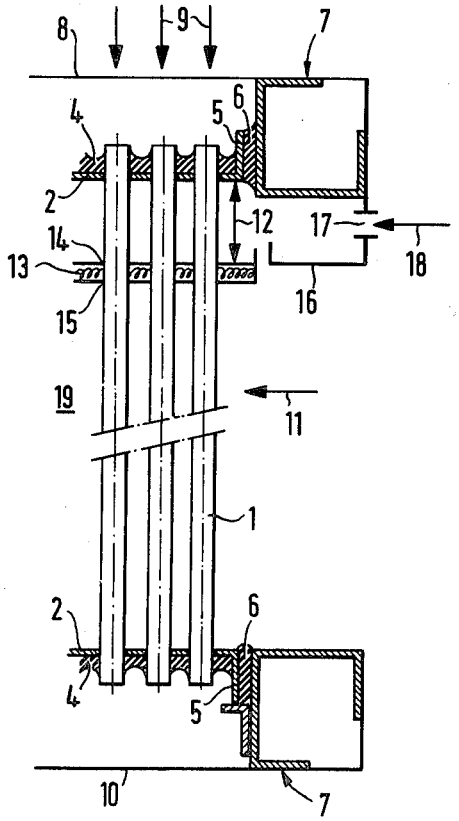
FIG. 2 shows a vertical section through a part of the heat exchanger for illustrating constructional elements.

The perforated sheet metal plates (2) are formed trough-like as can be seen from FIG. 2. In these troughs A casting resin of silicon is poured into the troughs A so that layers (4) of casting resin are formed which hold and seal the tubes (1) at one end. The troughs have on their outer raised flanges (5). A layer (6) of casting resin is applied to the outer surface of the flanges (5). The layer (6) serves to take up the longitudinal thermal changes between the stack of tubes (1) and the housing of the tubular heat exchanger.

The housing consists of bore-like framework of sheet metal strips (7) surrounding the tubes. In the housing there is provided in addition an inlet opening (8) for a first medium flowing in the direction of the arrow (9), preferably air, at an ambient temperature or cold air. This medium flows through the tubes (1) in their longitudinal direction and leaves the tubular heat exchanger through an outlet (10).

A second medium is led through the heat exchanger at right angles to the tubes (1) which medium enters the housing in the direction of the arrow (11) and leaves the housing again in the same direction. If the first medium is colder than the second medium then the second medium is cooled. The second medium is preferably heated air or a heated gas.

In order to improve any drawbacks described above there is arranged according to the invention at a short distance (12) from the layer (4) a further layer (13) of mineral wool or glass wool parallel to the layer (4). This layer is located between an upper perforated sheet metal plate (14) and a lower perforated sheet metal plate (15). The sheet metal plates press the wool into a pack.

An inlet (17) to the space between the layers (4) and (13) is formed by a sheet metal plate 16 so that in the direction of the arrow (18) a further medium can flow into this space. This medium is preferably air or a gas at a higher pressure as compared with the pressure in the chamber (19) of the heat exchanger.

Figure 3:
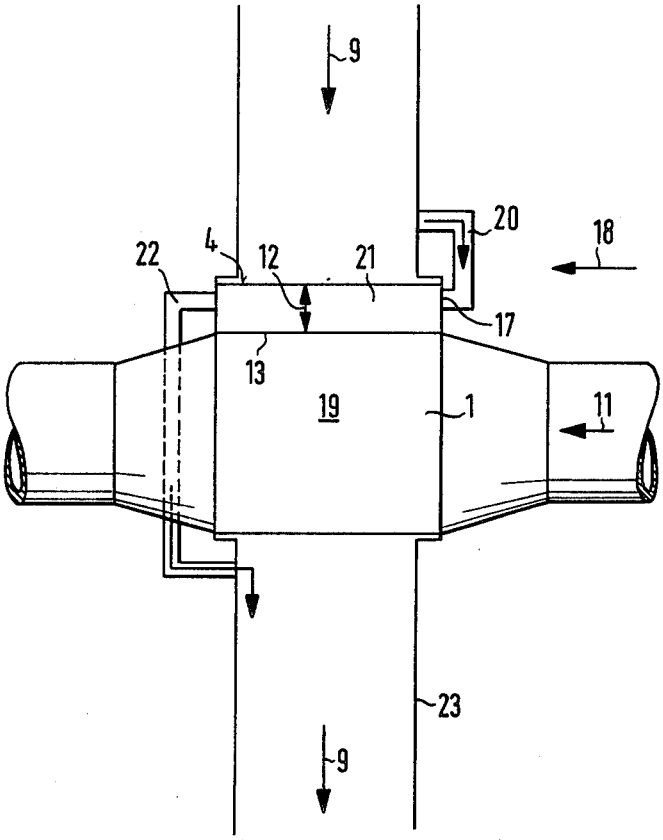
FIG. 3 shows a sectional view corresponding to FIG. 2 for explanation of a variation with further details.

FIG. 3 shows a variation in which the first medium flowing in the direction of the arrow (9) enters the space (21) between the layers (4) and (13) through a channel (20) into the inlet (17). This medium is at a higher pressure than the pressure in the space (19), and leaves the space (21) through a further channel (22) which is connected to a pipe (23) in line with the direction of flow, behind the tubular heat exchanger.

Any desired fluid may flow in the direction of the arrow (9), preferably a heated gas flows in the direction of the arrow (11) in order that there is no danger of any chemically corrosive acids involved in the gas being deposited on the outer walls of the pipes (1).

What we claim is:

1. A tubular heat exchanger comprising a housing, upper and lower perforated sheet metal plates mounted on the housing, a vertical stack of tubes surrounded by a chamber within the housing, said tubes being mounted adjacent their ends to the upper and lower plates through the perforations, a layer of heat-and acid-sensitive casting resin sealing the tube ends to the upper plate, inlet and outlet means on the housing for flowing a first fluid medium in a vertical direction through the stack of tubes, inlet and outlet means on the housing for flowing a second fluid medium through the chamber surrounding the tube stack, said second fluid medium being at an elevated temperature and including constituents that may cause corrosion of the casting resin layer, and means for preventing thermal and corrosive damage to the casting resin layer, said damage-preventing means comprising a further plate-like member located between the upper and lower metal plates and spaced from the said upper metal plate containing the casting resin to form a space therebetween, said further plate-like member and the said space functioning to separate the second medium from the casting resin and protect the latter from thermal and corrosive damage, inlet and outlet means on the housing for the said space between the upper metal plate and the further plate-like member, and means to supply a third fluid medium to the space inlet means for flowing the third medium through and cooling the said space, said third fluid medium being at a higher pressure than the pressure within the chamber, said further plate-like member comprising two plates with a layer of acid- and heat-resistant material sandwiched therebetween.

2. A tubular heat exchanger as claimed in claim 1 wherein the tubes are of glass and the casting resin is of the silicon type.

3. A tubular heat exchanger as claimed in claim 1 wherein the second fluid medium flows at right angles to the vertical tubes.

4. A tubular heat exchanger as claimed in claim 1 wherein the said layer of acid- and heat-resistant material consists of mineral wool or glass wool.

* * * * *